US007364323B2

(12) United States Patent
Francois

(10) Patent No.: US 7,364,323 B2
(45) Date of Patent: Apr. 29, 2008

(54) POOL LIGHT MOUNTING SYSTEM

(76) Inventor: Alain Francois, 7726 Deering Ave., Canoga Park, CA (US) 91304

( * ) Notice: Subject to any disclaimer, the term of this patent is extended or adjusted under 35 U.S.C. 154(b) by 106 days.

(21) Appl. No.: 11/520,458

(22) Filed: Sep. 13, 2006

(65) Prior Publication Data

US 2007/0170322 A1 Jul. 26, 2007

Related U.S. Application Data

(60) Provisional application No. 60/766,533, filed on Jan. 25, 2006.

(51) Int. Cl.
*F21V 29/00* (2006.01)

(52) U.S. Cl. ..... 362/267; 362/101; 362/396; 362/440; 362/443; 362/445; 248/200; 248/74.1; 248/74.2; 248/74.3; 248/62

(58) Field of Classification Search ..... None
See application file for complete search history.

(56) References Cited

U.S. PATENT DOCUMENTS

| | | | | | |
|---|---|---|---|---|---|
| 2,399,899 | A * | 5/1946 | Tinnerman | 174/40 CC |
| 2,906,863 | A * | 9/1959 | Ritter | 362/267 |
| 4,433,366 | A * | 2/1984 | Wade | 362/267 |
| 4,539,629 | A * | 9/1985 | Poppenheimer | 362/267 |
| 4,557,447 | A * | 12/1985 | Combe | 248/74.1 |
| 4,767,087 | A * | 8/1988 | Combu | 248/62 |
| 4,782,430 | A | 11/1988 | Robbins et al. | |
| 4,971,283 | A | 11/1990 | Tilsner | |
| 5,045,978 | A | 9/1991 | Gargle | |
| 5,050,052 | A * | 9/1991 | Wade | 362/101 |
| 5,213,410 | A | 5/1993 | Acks | |
| 6,250,776 | B1 * | 6/2001 | Burkitt et al. | 362/267 |
| 6,481,673 | B1 * | 11/2002 | Roe et al. | 248/62 |
| 7,244,048 | B2 * | 7/2007 | Poggi | 362/267 |
| 2003/0019983 | A1 * | 1/2003 | Iinuma et al. | 248/200 |
| 2006/0072323 | A1 | 4/2006 | Poggi | |

* cited by examiner

*Primary Examiner*—Sandra O'Shea
*Assistant Examiner*—Danielle Dunn
(74) *Attorney, Agent, or Firm*—David A. Belasco; Belasco Jacobs & Townsley, LLP

(57) ABSTRACT

A pool light mounting system includes a circular band formed of resilient material. The band has first and second adjusting brackets at either end. The brackets have substantially planar surfaces located orthogonally to the band. The planar surfaces have first and second apertures penetrating the surfaces. The apertures are sized to fit slidably over a threaded stud. First and second nuts are threaded to fit the threaded stud and located on the stud located within the first and second apertures. First and second mounting brackets are attached to the band having third and fourth planar surfaces spaced forwardly from and parallel to a front edge of the band. The third surface has a receiving notch for a mounting hook. The fourth surface is located opposite the first mounting bracket along the band and has a threaded hole sized and shaped to accept a threaded mounting screw for a lighting fixture.

8 Claims, 4 Drawing Sheets

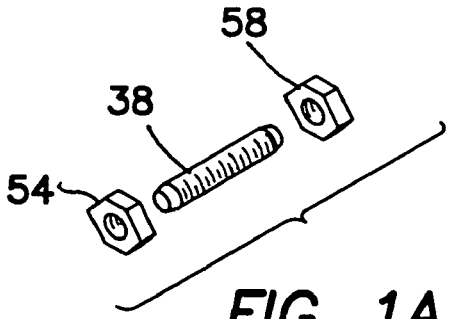
FIG. 1A
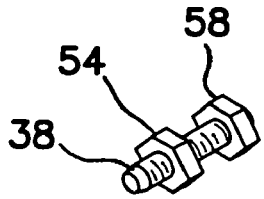
FIG. 1B
FIG. 2
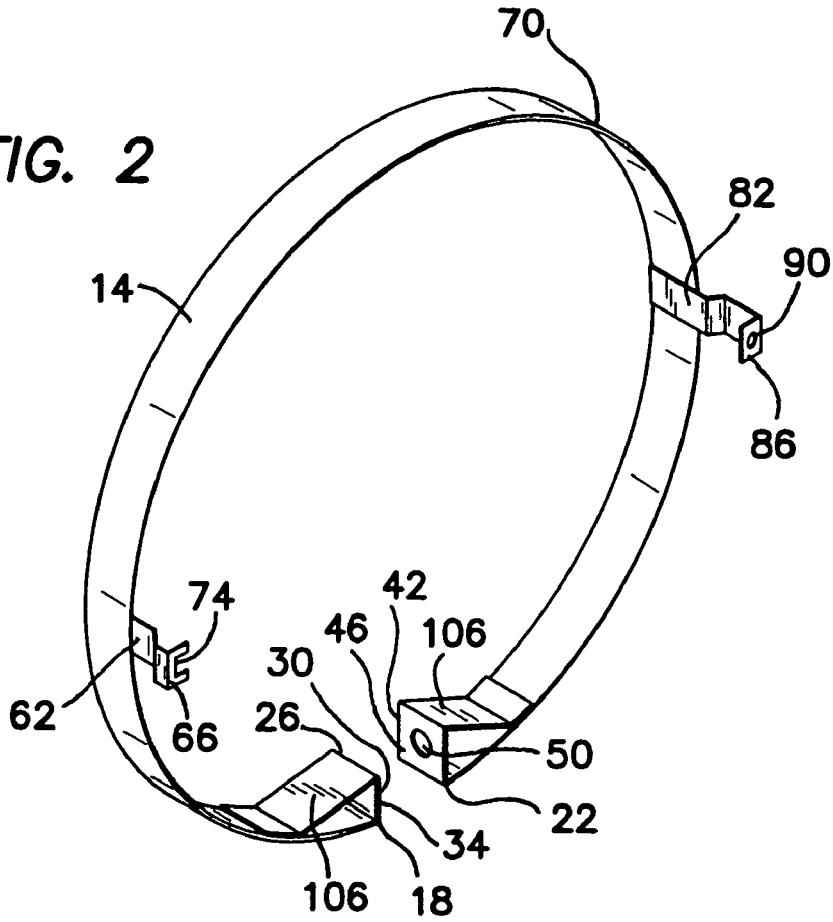

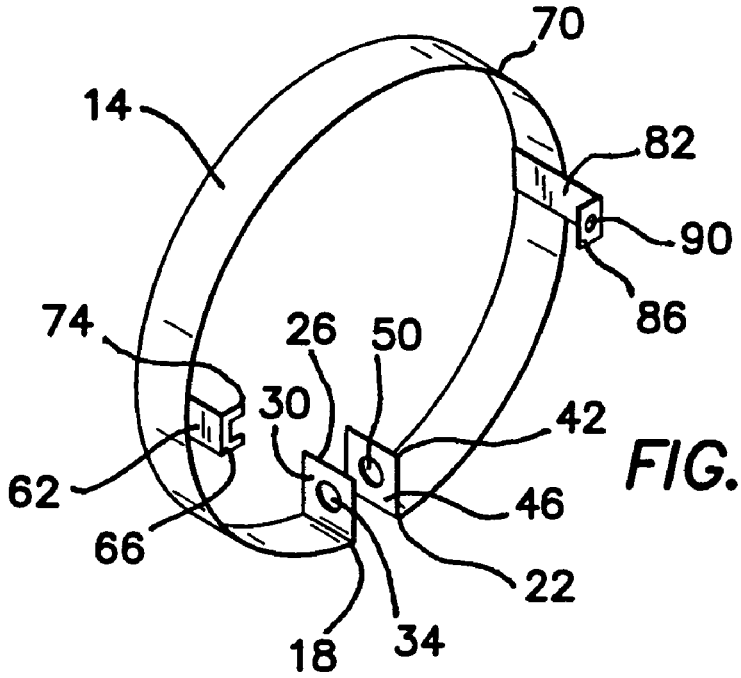
FIG. 4
FIG. 5
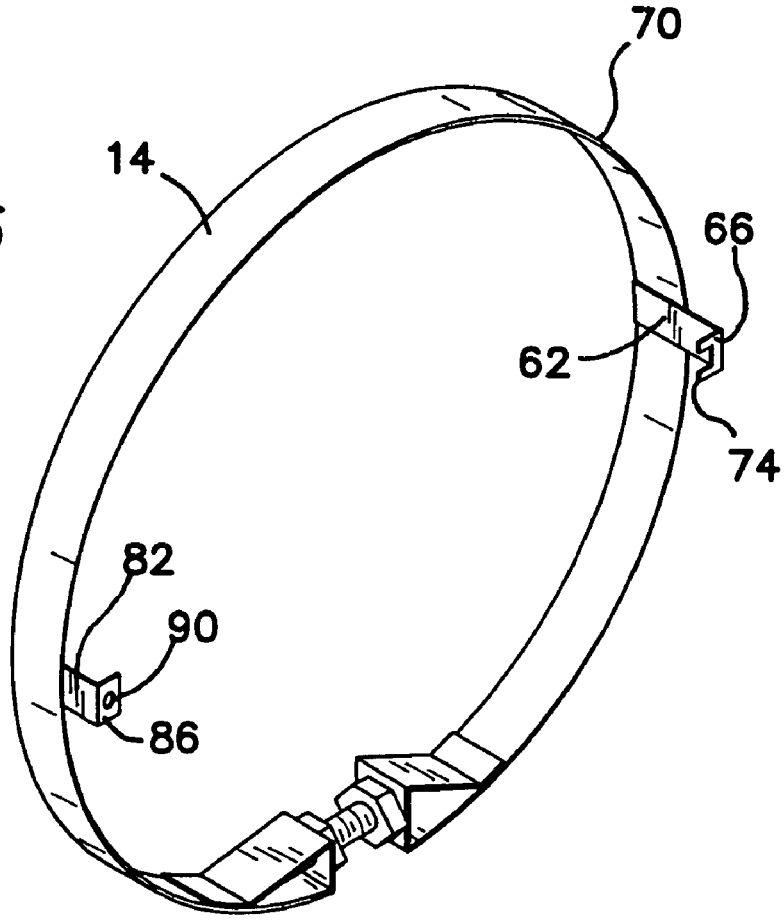

POOL LIGHT MOUNTING SYSTEM

CLAIM OF PRIORITY

The instant application claims priority from U.S. Provisional Application Ser. No. 60/766,533 filed Jan. 25, 2006.

FIELD OF INVENTION

The invention pertains to underwater lighting systems. More particularly, the invention relates to replacement mounting fixtures for swimming pool lights.

BACKGROUND OF THE INVENTION

Underwater swimming pool lights are generally set into niches in the sides or bottom of swimming pools. As these pools age, lighting fixtures mounted in these niches often fail. The mountings electrolyze and the niches deteriorate. This deterioration makes mounting of a replacement fixture in the same niche difficult and the replacement fixtures often wobble or are difficult to aim properly. The present invention provides an adaptable means for securing a replacement lighting fixture in a mounting niche which has deteriorated through age and wear.

U.S. Pat. No. 4,971,283, issued to Tilsner discloses wedge device particularly suitable for use in mounting a swimming pool light in a niche formed in a wall of the pool has a wedge member and a drive member for use in driving the wedge member between the side of the light and the wall of the niche. The drive member is pivotally mounted on the wedge member for limited slidable freedom of motion laterally as well as rotatable motion by means of a pair of trunnions which extend therefrom and fit into cylindrical sleeve bearings formed in the wedge member. A screw member threadably engages the drive member and is inserted through an aperture in the mounting ring for the light. When the screw is tightened against the mounting ring, it draws the wedge member against a side of the light and the wall of niche thereby wedging the light in place. The drive member can be rotated ninety degrees on its trunnions to change the size of the wedge provided by the wedge member thus enabling its use under different installation requirements.

U.S. Pat. No. 6,250,776, issued to Burkitt, et al. is directed to a niche assembly for a pool having outer wall, flange and boss formed on the flange. The boss is configured to inset in small hole of pool wall when the niche is fully inserted into large hole. At least one handle is formed on backup ring that screws on to the niche to mount the niche to the pool wall. The inset boss prevents rotation of the niche. The niche further includes plurality of ribs formed on the outer wall. The backup ring further includes a tab projecting towards the ribs. The tab and the ribs cooperate to impede unscrewing the backup ring off the niche. A seal ring and a gasket seal a vinyl liner to the flange. The seal ring has a sloping outer edge and the flange has a beveled outer edge.

U.S. Pat. No. 5,045,978, issued to Gargle illustrates an underwater lighting fixture mounted in an aperture formed in the wall of a spa or other reservoir of water. An open-ended outer housing is disposed in a receiving aperture in the wall, and is secured thereto by a watertight coupling, the opening in the housing being directed to the interior of the enclosure. A light bulb and the electrical connections are mounted within the housing, the interior cavity of the housing being cylindrical and having screw threads disposed about the inner circumference of the housing. The lens of the lighting fixture is integral with an inner cylindrical housing having screw threads disposed about the outer circumference thereof and being adapted to engage the receiving screw threads disposed on the interior surface of the outer housing. The inner housing is rotatably secured by engaging the screw threads thereby forming a watertight seal therebetween.

U.S. Pat. No 5,213,410, issued to Acks discloses an underwater illumination apparatus for use in nuclear facilities. It has a high pressure sodium arc lamp sealed to a stainless steel base with a flexible, radiation-resistant seal to provide a watertight and shock-absorbing connection. A wet-mateable base connector is attached to the base to permit connection to a lower cable. A light-transmissive, impact-resistant cover is formed around the base and the arc lamp. The cover has holes through which water can flow in and out to conduct heat away from the arc lamp. The combination of the above elements creates a modular unit which is replaced as a whole when the arc lamp burns out. The lower cable which provides power to the arc lamp is attached at its other end to a ballast power supply which is hermetically sealed in a stainless steel housing. Wet mateable connectors are attached at the inlet and outlet of the ballast power supply to attach to the lower cable and to the upper cable connection to a 120 VAC source. A number of units may be assembled with a single reflector to create a light ring.

U.S. Pat. No. 4,782,430, issued to Robbins is directed to a waterproof coupling for use in conjunction with illumination systems for swimming pools, spas, and the like. It employs a light conduit placed within the waterproof fitting. The waterproof fitting is installed in a wall of a water-retaining structure, remote from said light conduit illumination system wherein said waterproof fitting includes a hollow screw having a transparent head which acts as a lens, a face plate having a threaded central aperture through which said hollow screw is inserted, an elongated male coupling have a gripping surface, a flange member disposed in front of the gripping surface, integrally molded threads on the exterior surface of the elongated male coupling, and a central aperture through the elongated male coupling, through which said hollow screw and said face plate assembly are inserted, a gasket disposed between the flange of said elongated male coupling and said face plate, at least one lock nut threaded onto said hollow screw to draw the transparent head against said face plate, a nut threaded onto said integrally molded threads of said elongated male coupling to compress said gasket into sealing engagement between said face plate and said elongated male coupling, and a plurality of fasteners attaching said face plate to the gripping surface of said elongated male coupling.

U.S. Pat. No. 4,433,366, issued to Wade discloses a structure for providing a light in the side of a swimming pool beneath the water. The structure primarily is constructed from sheet metal and includes a bulb shield and receptacle, a front lens, a front mounting ring and a sealing ring. The sealing ring forces portions of the shield and the mounting ring into sealing arrangement with a ring seal mounted about the lens. The seal and the adjacent sealing structure allow steam which may be generated by heat from the enclosed bulb to escape into the water but prevent the water from entering the structure. The structure can be used in traditional concrete or Gunite pools and with an additional component, it can be installed in vinyl lined pools.

U.S. patent application No. 2006/0072323, issued to Poggi describes a pool light assembly configured to be a single unit of a lamp permanently sealed into its niche, such that upon the need for repair, the entire unit would be replaced It is an objective of the present invention to provide a means to replace broken or damaged lighting fixtures in swimming pools and spas. It is a further objective to provide an adjustable repair bracket that can fit pool niches of varying sizes and configurations. It is a still further objective of the invention to provide such a repair bracket that will work with plastic niches requiring a separate grounding strap. It is yet a further objective to provide a repair bracket that is easily installed with common hand tools. Finally, it is an objective of the present invention to provide a repair bracket that is durable and easily manufactured.

While some of the objectives of the present invention are disclosed in the prior art, none of the inventions found include all of the requirements identified.

SUMMARY OF THE INVENTION

The present invention addresses all of the deficiencies of prior art pool light mounting system inventions and satisfies all of the objectives described above.

(1) A pool light mounting system providing the desired features may be constructed from the following components. A circular band is provided. The band is formed of resilient material and has a first end and a second end. A first adjusting bracket is provided. The first bracket is formed at the first end. It includes a first substantially planar surface located orthogonally to the band at the first end. The first substantially planar surface has a first aperture penetrating the first surface. The first aperture is sized to fit slidably over a threaded stud.

A second adjusting bracket is provided. The second bracket is formed at the second end. It includes a second substantially planar surface located orthogonally to the band at the second end. The second substantially planar surface has a second aperture penetrating the second surface. The second aperture is sized to fit slidably over the threaded stud. First and second nuts are provided. The nuts are threaded to fit the threaded stud and located on the stud. The threaded stud is located within the first and second apertures. A first mounting bracket is provided. The first mounting bracket is attached to the circular band and has a third planar surface. The third surface is spaced forwardly from and parallel to a front edge of the band. The third surface has a receiving notch. The notch is sized and shaped to accept a mounting hook.

A second mounting bracket is provided. The second mounting bracket is attached to the circular band and has a fourth planar surface. The fourth surface is spaced forwardly from and parallel to the front edge of the band and located opposite the first mounting bracket along the circular band. The fourth surface has a threaded hole. The hole is sized and shaped to accept a threaded mounting screw. When the circular band is inserted into a pool niche and the first and second nuts are turned toward the first and second planar surfaces, the band will expand to fit tightly in the niche. When a lighting fixture is inserted into the band, a mounting hook will fit slidably into the notch and a mounting screw will fit into the threaded hole, thereby securing the lighting fixture into the niche.

(2) In a variant of the invention, at least one of the first and second adjusting brackets further includes a reinforcing brace. The brace extends from at least one of the first and second substantially planar surfaces back along the circular band.

(3) In another variant, at least one of the reinforcing braces is attached to the circular band.

(4) In still another variant, the pool light mounting system further includes a bonding strap. The bonding strap is formed of electrically conductive material, attached to the circular band adjacent a first end and has a mounting aperture adjacent a second end.

(5) In yet another variant, the bonding strap extends rearwardly from either of the first and second mounting brackets.

(6) In a further variant, the circular band, the first and second adjusting brackets and the first and second mounting brackets are formed of material selected from the group consisting of stainless steel, brass, aluminum and chrome-plated steel.

(7) A method of repairing a damaged pool light mounting system includes the steps of determining the material a niche containing a damaged pool lighting fixture in a pool is made of. Preparing a replacement pool light mounting system that includes a circular band. The band is formed of resilient material and has a first end and a second end. A first adjusting bracket is provided. The first bracket is formed at the first end and includes a first substantially planar surface located orthogonally to the band at the first end. The first substantially planar surface has a first aperture penetrating the first surface. The first aperture is sized to fit slidably over a threaded stud.

A second adjusting bracket is provided. The second bracket is formed at the second end and includes a second substantially planar surface located orthogonally to the band at the second end. The second substantially planar surface has a second aperture penetrating the second surface, the second aperture is sized to fit slidably over the threaded stud. First and second nuts are provided. The nuts are threaded to fit the threaded stud and located on it. The threaded stud is located within the first and second apertures. A first mounting bracket is provided. The first mounting bracket is attached to the circular band and has a third planar surface. The third surface is spaced forwardly from and parallel to a front edge of the band. The third surface has a receiving notch. The notch is sized and shaped to accept a mounting hook.

A second mounting bracket is provided. The second mounting bracket is attached to the circular band and has a fourth planar surface. The fourth surface is spaced forwardly from and parallel to a front edge of the band and located opposite the first mounting bracket along the circular band. The fourth surface has a threaded hole. The hole is sized and shaped to accept a threaded mounting screw.

Further steps include removing an existing light from the niche. Removing any plaster from the inside of the niche. Removing the threaded stud and the first and second nuts from the first and second adjusting brackets. Threading the first and second nuts to center of the stud. Sliping the circular band around light wiring. Squeezing the circular ring together. Inserting the ring into the niche. Inserting the threaded stud and the first and second nuts into the first and second adjusting brackets. Twisting the first and second nuts opposite each other to hold the circular band in place in the niche. Adjusting the circular band to locate the third and fourth planar surfaces of the first and second mounting brackets substantially flush with an outer surface of the pool. Tightening the first and second nuts against the first and second adjusting brackets to secure the circular band within the niche. Reinstalling the lighting fixture in the niche.

(8) In a variant of the method of repairing a damaged pool light mounting system further includes the steps of preparing a replacement pool light mounting system that further includes a bonding strap. The bonding strap is formed of electrically conductive material, attached to the circular band adjacent a first end and has a mounting aperture adjacent a second end. Attaching the bonding strap at the mounting aperture to a bonding connector in the niche, when the niche is formed of plastic.

An appreciation of the other aims and objectives of the present invention and an understanding of it may be achieved by referring to the accompanying drawings and the detailed description of a preferred embodiment.

DESCRIPTION OF THE DRAWINGS

FIG. 1A is a perspective view of a threaded stud and two nuts for attachment to said stud;

FIG. 1B is a perspective view of said threaded stud with said two nuts attached thereto;

FIG. 2 is a perspective view of a variant of the FIG. 1 embodiment with offset mounting brackets;

FIG. 4 is a perspective view of a third embodiment having a second style of adjusting bracket; and FIG. 5 is a perspective view of a fourth embodiment in which the mounting brackets are reversed.

DETAILED DESCRIPTION OF THE PREFERRED EMBODIMENT (1) FIGS. 1-5 illustrate a pool light mounting system 10 providing the desired features that may be constructed from the following components. A circular band 14 is provided. The band 14 is formed of resilient material and, as illustrated in FIG. 4, has a first end 18 and a second end 22. A first adjusting bracket 26 is provided. The first bracket 26 is formed at the first end 18. It includes a first substantially planar surface 30 located orthogonally to the band 14 at the first end 18. The first substantially planar surface 30 has a first aperture 34 penetrating the first surface 30. The first aperture 34 is sized to fit slidably over a threaded stud 38.

A second adjusting bracket 42 is provided. The second bracket 42 is formed at the second end 22. It includes a second substantially planar surface 46 located orthogonally to the band at the second end 22. The second substantially planar surface 46 has a second aperture 50 penetrating the second surface 46. The second aperture 50 is sized to fit slidably over the threaded stud 38. First 54 and second nuts 58 are provided. As illustrated in FIG. 1, the nuts 54, 58 are threaded to fit the threaded stud 38 and located on the stud 38. The threaded stud 38 is located within the first 34 and second 50 apertures. A first mounting bracket 62 is provided. The first mounting bracket 62 is attached to the circular band 14 and has a third planar surface 66. The third surface 66 is spaced forwardly from and parallel to a front edge 70 of the band 14. The third surface 66 has a receiving notch 74. The notch 74 is sized and shaped to accept a mounting hook 78.

Figure 1:
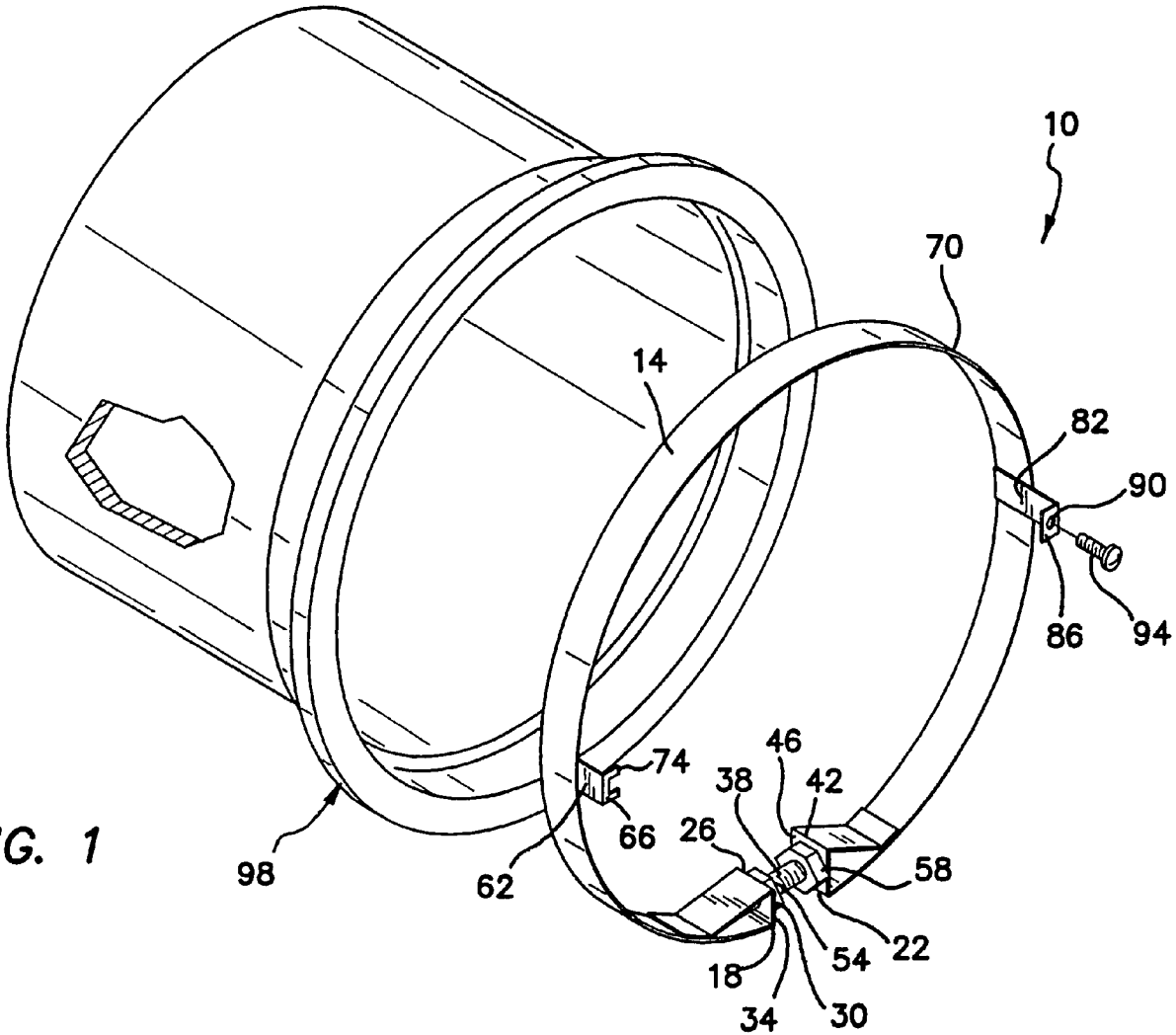
FIG. 1 is a perspective view of the preferred embodiment of the invention disposed in front of a metal lighting niche.

A second mounting bracket 82 is provided. The second mounting bracket 82 is attached to the circular band 14 and has a fourth planar surface 86. The fourth surface 86 is spaced forwardly from and parallel to the front edge 70 of the band 14 and located opposite the first mounting bracket 62 along the circular band 14. The fourth surface 86 has a threaded hole 90. The hole 90 is sized and shaped to accept a threaded mounting screw 94. When the circular band 14 is inserted into a pool niche 98 and the first 54 and second 58 nuts are turned toward the first 30 and second 46 planar surfaces, the band 14 will expand to fit tightly in the niche 98. When a lighting fixture 102 is inserted into the band 14, a mounting hook 78 will fit slidably into the notch 74 and a mounting screw 94 will fit into the threaded hole 90, thereby securing the lighting fixture 102 into the niche 98.

(2) In a variant of the invention, as illustrated in FIG. 2, at least one of the first 26 and second 42 adjusting brackets further includes a reinforcing brace 106. The brace 106 extends from at least one of the first 30 and second 46 substantially planar surfaces back along the circular band 14.

(3) In another variant, as illustrated in FIG. 2, at least one of the reinforcing braces 106 is attached to the circular band 14.

Figure 3:
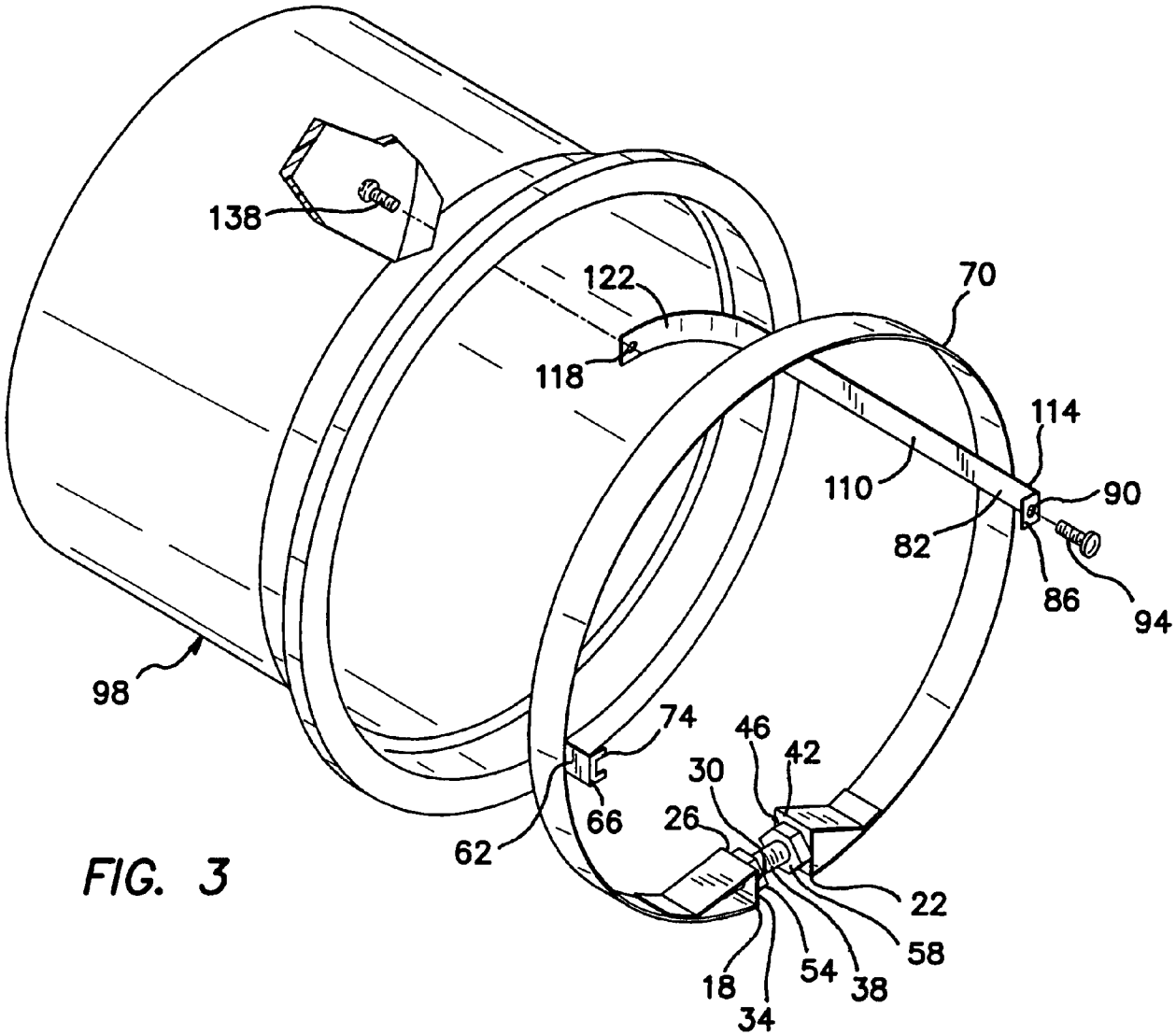
FIG. 3 is a perspective view of a second embodiment having a bonding strap and disposed in front of a plastic lighting niche with an attachment screw for the bonding strap.

(4) In still another variant, as illustrated in FIG. 3, the pool light mounting system 10 further includes a bonding strap 110. The bonding strap 110 is formed of electrically conductive material, attached to the circular band 14 adjacent a first end 114 and has a mounting aperture 118 adjacent a second end 122.

(5) In yet another variant, as illustrated in FIG. 3, the bonding strap 110 extends rearwardly from either of the first 62 and second 82 mounting brackets.

(6) In a further variant, the circular band 14, the first 26 and second 42 adjusting brackets and the first 62 and second 82 mounting brackets are formed of material selected from the group consisting of stainless steel, brass, aluminum and chrome-plated steel.

(7) A method of repairing a damaged pool light mounting system includes the steps of determining the material a niche 98 containing a damaged pool lighting fixture 102 in a pool 126 is made of. Preparing a replacement pool light mounting system 10 that includes a circular band 14. The band 14 is formed of resilient material and has a first end 18 and a second end 22. A first adjusting bracket 26 is provided. The first bracket 26 is formed at the first end 18 and includes a first substantially planar surface 30 located orthogonally to the band 14 at the first end 18. The first substantially planar surface 30 has a first aperture 34 penetrating the first surface 30. The first aperture 34 is sized to fit slidably over a threaded stud 38.

A second adjusting bracket 42 is provided. The second bracket 42 is formed at the second end 22 and includes a second substantially planar surface 46 located orthogonally to the band 14 at the second end 22. The second substantially planar surface 46 has a second aperture 50 penetrating the second surface 46, the second aperture 50 is sized to fit slidably over the threaded stud 38. First 54 and second 58 nuts are provided. The nuts 54, 58 are threaded to fit the threaded stud 38 and located on it. The threaded stud 38 is located within the first 34 and second 50 apertures. A first mounting bracket 62 is provided. The first mounting bracket 62 is attached to the circular band 14 and has a third planar surface 66. The third surface 66 is spaced forwardly from and parallel to a front edge 70 of the band 14. The third surface 66 has a receiving notch 74. The notch 74 is sized and shaped to accept a mounting hook 78.

A second mounting bracket 82 is provided. The second mounting bracket 82 is attached to the circular band 14 and has a fourth planar surface 86. The fourth surface 86 is spaced forwardly from and parallel to a front edge 70 of the band 14 and located opposite the first mounting bracket 62 along the circular band 14. The fourth surface 86 has a threaded hole 90. The hole 90 is sized and shaped to accept a threaded mounting screw 94.

Further steps include removing an existing lighting fixture 102 from the niche 98. Removing any plaster from the inside of the niche 98. Removing the threaded stud 38 and the first 54 and second 58 nuts from the first 26 and second 42 adjusting brackets. Threading the first 54 and second 58 nuts to center of the stud 38. Slipping the circular band 14 around light wiring 130. Squeezing the circular ring 14 together. Inserting the ring 14 into the niche 98. Inserting the threaded stud 38 and the first 54 and second 58 nuts into the first 26 and second 42 adjusting brackets. Twisting the first 54 and second 58 nuts opposite each other to hold the circular band 14 in place in the niche 98. Adjusting the circular band 14 to locate the third 66 and fourth 86 planar surfaces of the first 62 and second 82 mounting brackets substantially flush with an outer surface 134 of the pool 126. Tightening the first 54 and second 58 nuts against the first 26 and second 42 adjusting brackets to secure the circular band 14 within the niche 98. Reinstalling the lighting fixture 102 in the niche 98.

(8) In a variant of the method of repairing a damaged pool light mounting system further includes the steps of preparing a replacement pool light mounting system 10 that further includes a bonding strap 110. The bonding strap 110 is formed of electrically conductive material, attached to the circular band 14 adjacent a first end 114 and has a mounting aperture 118 adjacent a second end 122. Attaching the bonding strap 110 at the mounting aperture 118 to a bonding connector 138 in the niche 98, when the niche 98 is formed of plastic.

The pool light mounting system 10 has been described with reference to particular embodiments. Other modifications and enhancements can be made without departing from the spirit and scope of the claims that follow.

The invention claimed is:

1. A pool light mounting system, comprising:

a circular band, said band being formed of resilient material and having a first end and a second end;

a first adjusting bracket, said first bracket being formed at said first end comprising a first substantially planar surface disposed orthogonally to said band at said first end;

said first substantially planar surface having a first aperture penetrating said first surface, said first aperture being sized to fit slidably over a threaded stud;

a second adjusting bracket, said second bracket being formed at said second end comprising a second substantially planar surface disposed orthogonally to said band at said second end;

said second substantially planar surface having a second aperture penetrating said second surface, said second aperture being sized to fit slidably over said threaded stud;

first and second nuts, said nuts being threaded to fit said threaded stud and disposed thereon;

said threaded stud disposed within said first and second apertures;

a first mounting bracket, said first mounting bracket being attached to said circular band and having a third planar surface, said third surface being spaced forwardly from and parallel to a front edge of said band;

said third surface having a receiving notch, said notch being sized and shaped to accept a mounting hook;

a second mounting bracket, said second mounting bracket being attached to said circular band and having a fourth planar surface, said fourth surface being spaced forwardly from and parallel to a front edge of said band and disposed opposite said first mounting bracket along said circular band;

said fourth surface having a threaded hole, said hole being sized and shaped to accept a threaded mounting screw;

whereby, when said circular band is inserted into a pool niche and said first and second nuts are turned toward said first and second planar surfaces, said band will expand to fit tightly in said niche and when a lighting fixture is inserted into said band, a mounting hook will fit slidably into said notch and a mounting screw will fit into said threaded hole, thereby securing said lighting fixture into said niche.

2. The pool light mounting system, as described in claim 1, wherein at least one of said first and second adjusting brackets further comprise a reinforcing brace, said brace extending from at least one of said first and second substantially planar surfaces back along said circular band.

3. The pool light mounting system, as described in claim 2, wherein at least one of said reinforcing braces is attached to said circular band.

4. The pool light mounting system, as described in claim 1, further comprising a bonding strap, said bonding strap being formed of electrically conductive material, attached to said circular band adjacent a first end and having a mounting aperture adjacent a second end.

5. The pool light mounting system, as described in claim 4, wherein said bonding strap extends rearwardly from either of said first and second mounting brackets.

6. The pool light mounting system, as described in claim 1, wherein said circular band, said first and second adjusting brackets and said first and second mounting brackets are formed of material selected from the group consisting of:

stainless steel, brass, aluminum and chrome-plated steel.

7. A method of repairing a damaged pool light mounting system comprising the steps of:

determining the material comprising a niche containing a damaged pool light fixture in a pool;

preparing a replacement pool light mounting system comprising:

a circular band, said band being formed of resilient material and having a first end and a second end;

a first adjusting bracket, said first bracket being formed at said first end comprising a first substantially planar surface disposed orthogonally to said band at said first end;

said first substantially planar surface having a first aperture penetrating said first surface, said first aperture being sized to fit slidably over a threaded stud;

a second adjusting bracket, said second bracket being formed at said second end comprising a second substantially planar surface disposed orthogonally to said band at said second end;

said second substantially planar surface having a second aperture penetrating said second surface, said second aperture being sized to fit slidably over said threaded stud;

first and second nuts, said nuts being threaded to fit said threaded stud and disposed thereon;

said threaded stud disposed within said first and second apertures;

a first mounting bracket, said first mounting bracket being attached to said circular band and having a third planar surface, said third surface being spaced forwardly from and parallel to a front edge of said band;

said third surface having a receiving notch, said notch being sized and shaped to accept a mounting screw shaft;

a second mounting bracket, said second mounting bracket being attached to said circular band and having a fourth planar surface, said fourth surface being spaced forwardly from and parallel to a front edge of said band and disposed opposite said first mounting bracket along said circular band;

said fourth surface having a threaded hole, said hole being sized and shaped to accept a threaded mounting screw;

removing an existing lighting fixture from said niche;

removing any plaster from the inside of said niche;

removing said threaded stud and said first and second nuts from said first and second adjusting brackets;

threading said first and second nuts to center of said stud;

slipping said circular band around light wiring;

squeezing said circular ring together;

inserting said ring into said niche;

inserting said threaded stud and said first and second nuts into said first and second adjusting brackets;

twisting said first and second nuts opposite each other to hold said circular band in place in said niche;

adjusting said circular band to dispose said third and fourth planar surfaces of said first and second mounting brackets substantially flush with an outer surface of said pool;

tightening said first and second nuts against said first and second adjusting brackets to secure said circular band within said niche; and reinstalling said lighting fixture in said niche.

8. The method of repairing a damaged pool light mounting system, as described in claim 7, further comprising the steps of:

preparing a replacement pool light mounting system further comprising:

a bonding strap, said bonding strap being formed of electrically conductive material, attached to said circular band adjacent a first end and having a mounting aperture adjacent a second end; and attaching said bonding strap at said mounting aperture to a bonding connector in said niche, wherein said niche is formed of plastic.

* * * * *